US007964828B2

(12) United States Patent
Risman

(10) Patent No.: US 7,964,828 B2
(45) Date of Patent: Jun. 21, 2011

(54) MICROWAVE HEATING APPLICATOR

(75) Inventor: Per O. Risman, Härryda (SE)

(73) Assignee: EXH LLC, Eagan, MN (US)

( * ) Notice: Subject to any disclaimer, the term of this patent is extended or adjusted under 35 U.S.C. 154(b) by 1169 days.

(21) Appl. No.: 10/570,139

(22) PCT Filed: Sep. 2, 2004

(86) PCT No.: PCT/SE2004/001262

§ 371 (c)(1),
(2), (4) Date: Dec. 8, 2006

(87) PCT Pub. No.: WO2005/022956

PCT Pub. Date: Mar. 10, 2005

(65) Prior Publication Data

US 2007/0068937 A1 Mar. 29, 2007

(30) Foreign Application Priority Data

Sep. 2, 2003 (SE) ..... 0302337

(51) Int. Cl.
*H05B 6/74* (2006.01)

(52) U.S. Cl. ..... 219/693; 219/695

(58) Field of Classification Search ..... 219/693, 219/695, 690, 700, 746, 691, 756, 762, 701; 333/248, 228, 227

See application file for complete search history.

(56) References Cited

U.S. PATENT DOCUMENTS 3,843,862 A * 10/1974 Staats et al. ..... 219/750
5,828,040 A 10/1998 Risman

FOREIGN PATENT DOCUMENTS

| | | |
|---|---|---|
| EP | 0746182 | 12/1996 |
| WO | WO99/48335 | 9/1999 |
| WO | WO03/105534 | 12/2003 |

OTHER PUBLICATIONS

International Search Report (PCT/ISA/210).

* cited by examiner

*Primary Examiner* — Quang T Van
(74) *Attorney, Agent, or Firm* — Harness, Dickey & Pierce, P.L.C.

(57) ABSTRACT

A new type of microwave applicator has been disclosed. The applicator according to an embodiment of the invention makes use of an evanescent main power-transferring mode. This evanescent mode is complemented by a second mode, which is a propagating mode that has the purpose of providing a counter-directed magnetic field in the y-direction at the horizontal, y-directed applicator wall opening. The effect of the cooperation of the two applicator modes is that the field pattern extends over a significant distance below the applicator opening, such that a load placed below the applicator opening is heated by a field pattern of the mode combination.

19 Claims, 2 Drawing Sheets

MICROWAVE HEATING APPLICATOR

FIELD OF THE INVENTION

The present invention relates to the field of open-ended microwave applicators. More particularly, the invention relates to such applicators arranged to heat a load that is exterior to and not necessarily contacting the open end of the applicator. The load is typically transported on a microwave transparent conveyor. Below the conveyor, there is typically a metal structure acting both as a part of the overall microwave enclosure and as a means for improving the evenness of the load heating.

BACKGROUND OF THE INVENTION

Prior art microwave applicators with some similarities to the present invention are described in U.S. Pat. No. 5,828,040 and its European counterpart EP 0 746 182.

The particular single hybrid mode applicator in the referenced prior art solve a major problem of still earlier prior art, namely that of uneven heating and that of excessive edge overheating. Uneven heating is evidenced by a patchy and quite unpredictable heating pattern with hot and cold spots (caused by multimode action). Edge overheating typically occurs for loads having a high permittivity, such as typical compact food items. Edge overheating is caused by strong electric horizontal field components which are then parallel to the major edges of the food item.

The particular type of propagating hybrid mode in the applicator of the above prior art is characterized by very low vertically (z-direction) directed real impedance. This results in low horizontal (x- and y-direction) electric field strengths in relation to those of perpendicularly (z-directed) impinging plane waves. By the choice of a TEy hybrid mode, the y-directed electric field component in the applicator becomes zero, which is still more advantageous since edge overheating of y-directed load edges will then not occur. It should be noted that the feed orientation determines if the mode becomes a TEy or a TEx mode. The edge overheating effect is a non-resonant microwave diffraction phenomenon caused by an impinging E-field component parallel to the edge. This phenomenon is insensitive to the direction of impingement, as long as the resulting propagation in the wedge is away from its edge.

The particular low impedance applicator mode preferably has the lowest possible horizontal index (i.e. equal to 1) in the direction of transport of the load, since microwave leakage in that direction from the applicators is then minimized. Thereby, interaction (cross-coupling) between consecutive applicators in this direction is minimized, which reduces the complexity of the microwave choking structures at the tunnel end. With the load transport in the y-direction, the heating pattern of each individual applicator in moving loads therefore becomes striped. This is compensated for by a sideways (i.e. in the x-direction) staggering of consecutive applicators or applicator rows.

The particular low impedance TEy mode has a tendency to create a trapped surface wave mode (a so-called Longitudinal Section Magnetic mode, or LSM-mode) in the region including the underside of the load items and the metallic bottom structure of the tunnel. Although such modes result in a favorable heating from below in typical food items of about 15 mm or more in height, there is a problem when several staggered applicators are used in that a significant part of the heating pattern is determined by the x-directed standing LSM waves between the sidewalls of the tunnel oven, and not only by the fields of the individual applicators.

When the above-mentioned TEy mode is employed, there may be a tendency of both spreading-out of the applicator fields in the x-direction, and of cross-coupling between applicators. By cross-coupling, it is means an unwanted power transfer between adjacent applicators, either by direct coupling or by LSM mode coupling through the load region. The prior art referenced above does not provide any remedy to these imperfections.

According to the above-referenced prior art, the preferred embodiments comprise slot feed in the top of the applicator sidewalls, the applicator being designed for the $TEy_{11}$ or $TEy_{21}$ modes. However, there are cases when larger applicator openings are preferred, in order to achieve a lower power flux density to the load items without any need for reducing the output power of each microwave generator (magnetron). In order to successfully design microwave applicators for higher modes, e.g. $TEy_{31}$ or $TEy_{51}$ or $TEy_{71}$ modes, other microwave feeding means become necessary.

If the tunnel height is large, there will be an increased likelihood of microwave leakage through the tunnel ends into the surrounding ambient. For fixed tunnel heights, it is then possible to use various kinds of prior art chokes, such as delay lines, quarter-wave chokes and chokes which act by mode mismatching. Absorbing media may also be used for this purpose. Such chokes or absorbers are normally only applied to the horizontal surfaces (top and bottom) of the tunnel opening, but may also be used at the vertical side walls in the tunnel opening and choking region. However, if the tunnel height is to be variable, prior art choke structures in the vertical walls become very difficult to implement.

Another set of problems with the prior art is related to the overall height of the applicator plus the tunnel underneath. This is addressed in some detail in the referenced prior art, where the "effective height" in the system is a quite sensitive parameter. In order to achieve an acceptably low reflection factor (weak mismatching) of the system, constraints must be put on the "effective height" as well as on the permittivity of the load. In conjunction with this, it is to be noted that Brewster mode conditions are considered in the prior art to be the most desirable. Neither quarter-wave resonant modes, nor zero order modes are addressed.

SUMMARY OF THE INVENTION

An object of the present invention is to address the above-mentioned problems relating to x-directed LSM waves, applicator mode spread-out for large tunnel heights, and vertical tunnel wall choking.

This object is met by an open-ended applicator having a design that is characterized in that it employs two complementing TEy modes, one of which is evanescent (i.e. has a normalized wavelength v>1). This is in contradistinction to the referenced prior art, in which only one propagating mode is employed.

The evanescent mode, which is the main power transferring mode, is a $TEy_{m1}$ mode where the index m is preferably an odd number (m=3, 5 or 7). The second mode, which is simultaneously excited in the applicator, is a propagating mode and has the only purpose of providing a counter-directed magnetic field in the y-direction at the horizontal, y-directed applicator wall opening. The effect of the interaction between the two modes is that the fields of the major mode will continue to propagate downwards from the applicator opening in a relatively undisturbed and confined way towards the load.

By having the major mode evanescent, the comparative phase control becomes easier since the evanescent mode is phaseless, and the phase of the mode below the applicator does not vary to any significant extent for different tunnel heights and for different loads. This means that the sensitivity of the system to tunnel height and load becomes almost insignificant, at least within all practically useful variations. This can be expressed as the applicator mode becomes more isolated from the tunnel region with regard to system matching. The use of a major power transferring mode in the form of an evanescent mode together with another complementary applicator mode as described above is the main contribution of the present invention.

Obviously, the main mode cannot be strongly evanescent, since excessive field strength would then appear in the feed region of the applicator. The evanescence is characterized by its decay distance, which is the distance in a (mathematically) cylindrical waveguide over which the energy density decays by a factor of e (≈2.72). A desirable function is obtained if the decay distance is comparable to the applicator height over which the decay takes place.

It is to be noted that the forward and backward (reflected) waves of an evanescent mode are not orthogonal as for propagating modes. It follows that the reflection factor from a load below the applicator, as seen at the applicator ceiling feed, typically becomes lower than what would be expected based on the reflection factor of the load itself for this mode. This phenomenon contributes to the favorable practical properties of the inventive system.

Another advantage of the present invention is related to the behavior of the resonant condition which occurs in the system. The evanescent mode in a properly designed applicator system according to the invention becomes inherently resonant, since the excess capacitive energy of the evanescent mode in the applicator is offset by both an adjusted inductivity of the second, propagating mode, and by the impedance jump in the applicator opening region.

In one embodiment of the invention, the above effects are achieved by employing an evanescent $TEy_{31}$ mode for the main power transferring mode, together with a propagating $TEy_{11}$ mode for the second, counteracting mode. The excitation is then symmetrical around the center of the applicator ceiling in both the x- and y-directions. To excite these modes, at least two parallel, y-directed excitation slots are required. Such excitation geometry will also eliminate the excitation of all $TEy_{nm}$ modes when either or both indices m and n are even. This feeding geometry is an advantageous, general feature of the invention, since the applicator may in some embodiments need to be larger in the x-direction (dimension a) than in the y-direction (dimension b), making it possible for the applicator to support such unwanted higher modes. More particularly, it is desired to have a weak x-directed H-field (especially at the applicator walls at y=0 and y=b), such that leakage of microwave energy in the tunnel below becomes low in the y-direction. Therefore, a/m should be small and b/n should be large, leading to the fact that the a-dimension of the applicator needs to be larger than the b-dimension for some selections of supported modes.

The excitation by means of two parallel slots connecting the applicator to a $TE_{10}$ feeding waveguide, the slots having an elongation along the wide side of the applicator and being located at the sides of the feeding waveguide, results in the correct opposite polarity of the magnetic fields in the slots. In general, and for any type of feeding waveguide, feeding of microwave energy into the applicator should be performed such that the H-fields along the slot are anti-parallel. In other words, feeding could also be accomplished by other types of waveguides, such as a $TE_{11}$ or a $TE_{20}$ waveguide, the $TE_{10}$ type nevertheless being preferred.

However, in order for the transition between the feeding $TE_{10}$ waveguide and the applicator to also exhibit a good impedance transformation, it becomes theoretically and practically necessary to include reactive elements. In this context, it is preferred to add a quite large metal post at the center-line of the $TE_{10}$ waveguide, in a position halfway between the slots. This impedance matching by means of a reactive element in the form of a metal post centrally placed in the feeding waveguide is another useful feature of the invention.

When using a $TEy_{m;1}$ mode (where m=3, 5, 7, etc.) as the main power-transferring evanescent mode, the propagating complementary mode should in general be a $TEy_{m-2k;1}$ mode (where k=1, 2, 3, etc.). For example, when using the $TEy_{51}$ mode (m=5) as the evanescent main power-transferring mode, the complementary propagating mode could be the $TEy_{31}$ mode (k=1) or the $TEy_{11}$ mode (k=2). For physical reasons, of course, no index can become negative. However, it becomes increasingly difficult to eliminate unwanted modes from the applicators when higher mode indices are used. In order to eliminate such unwanted modes, it is preferred to have mode filters in the form of two or more y-directed metal rods or plates extending all the way between opposite applicator walls. The correct positions for these rods or plates can be determined by experiment or by electromagnetic modeling. The aim is thereby to obtain equal strength for the y-directed elongated hot zones under the applicator, which dominantly characterize the heating pattern, plus another, weaker, elongated hot zone just below each y-directed applicator side wall. The use of mode-discriminating bars or plates in the manner outlined above is another useful feature of the invention.

The major effect of unwanted LSM modes is that they create an x-directed propagation of energy, which is maintained also further sideways from the projection of the applicator opening on the metal plate (i.e. in the x-direction). The LSM mode or modes under the load is supported by x-directed currents in the metal plate below the belt and load. The unwanted propagation of these LSM modes beyond the desired limits can therefore be reduced if the x-directed current path in the metal plate is perturbed or interrupted. The preferred way of achieving this is to use a corrugated metal plate (where the corrugations are in the y-direction, i.e. in the direction of belt movement), or to mount or weld metal profiles on the plate which create a similar geometric conductor pattern. The varying height (the steps) of the plate cause changes in the x-directed impedance of the LSM mode, so that it is reflected mainly between adjacent steps. Again, the optimization of the metal plate corrugation pattern is preferably done by experiment and/or by electromagnetic modeling. The aim is then to obtain a good heating from below (i.e. to actually create an LSM mode) while minimizing spread-out in the x-direction from all sideways-mounted applicators. This use and optimization of the corrugations or the like is a further useful feature of the present invention.

All $TEy_{m1}$ modes have quite similar field characteristics at the vertical y-directed side walls. For example, there are dominating vertically directed magnetic fields near the side walls of the tunnel outside the heating section of the microwave tunnel. An efficient way of choking these fields, and thereby accomplishing a reduction of the microwave leakage in the tunnel openings, is to provide a horizontal elongated quarter-wave slot in the above-mentioned part of the tunnel side. This slot can be located a quite small vertical distance away from the applicator opening, which makes this approach applicable also for equipment having a variable tunnel height. This way of choking is yet another useful feature of the invention.

BRIEF DESCRIPTION OF THE DRAWINGS

The features of the present invention are illustrated on the accompanying drawings, on which.

Throughout the drawings, similar references are used for similar features.

DETAILED DESCRIPTION

Figure 1:
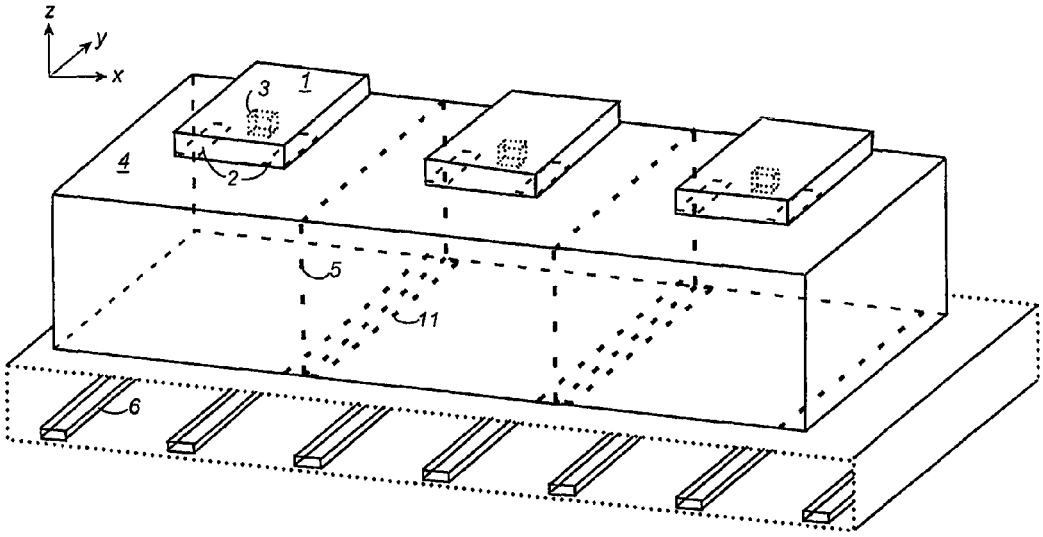
FIG. 1 shows a perspective view of an applicator arrangement according to the present invention.
Figure 2:
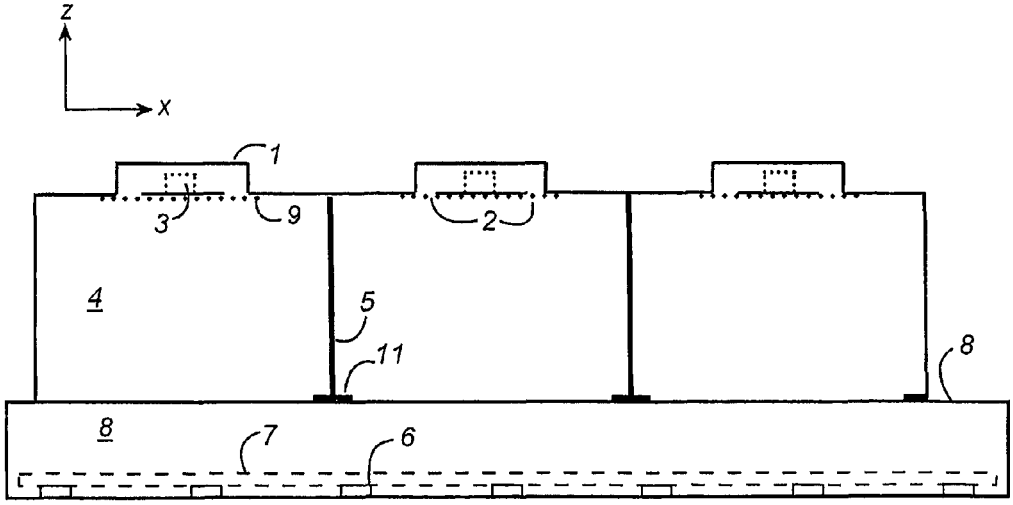
FIG. 2 shows a cross sectional view of an applicator arrangement according to the present invention.

One embodiment of an applicator arrangement according to the present invention will now be described. FIGS. 1 and 2 show a perspective view and a side view, respectively, of this embodiment, comprising an open-ended rectangular box with such dimensions that it can on the one hand enhance an evanescent $TEy_{31}$ mode in the applicator, and on the other hand create a significant amplitude of a propagating $TEy_{11}$ mode therein, so that a resonant condition occurs in the applicator itself including its opening region. The figures show three applicators 4 arranged side by side and separated by inter-applicator walls 5; however, the description below will mainly refer to a single applicator.

Although the present invention is described with reference to a microwave frequency of 2450 MHz, it will be clear to the skilled person that dimensions presented herein should be scaled linearly if other frequencies are employed.

As an example, the applicator inner dimensions of 183×306 mm in the x- and y-directions, and a height of 105 mm (the z-dimension) fulfill these criteria for the above-mentioned modes, and also the criterion of resonant behavior at the ISM frequency of 2450 MHz.

It is to be understood that the belt 7, carrying the load (not shown) to and from the applicator, has a direction of movement parallel to the y-dimension. The belt 7 and the load it carries move inside a tunnel 8.

It can be calculated directly by known analytical methods for waveguides that the decay distance for the evanescent $TEy_{31}$ mode is 91 mm, and the wavelength for the propagating $TEy_{11}$ mode is 132 mm. Hence, in line with a preferred selection according to the invention, the height of the applicator and the decay distance of the evanescent mode are selected to be about the same.

The applicator is fed from a $TE_{10}$ waveguide 1 by means of two parallel slots 2 in the ceiling of the applicator 4. Halfway between the slots 2, there is a reactive element in the form of a metal post 3. The purpose of this metal post is, as mentioned above, to provide good impedance transformation at the transition from the waveguide 1 to the applicator 4. The post 3 can be fixed either to the bottom or to the top of the waveguide. More details of the microwave feed to the applicator will be given further below. As for any microwave application, the feeding slots are suitably covered by some microwave transparent material 9 for practical reasons.

At the open end of the applicator, parallel to the y-dimension, there is provided horizontal flanges 11. A flange 11 of this kind has the effect of reducing diffraction in the x-direction at the lower edge of the applicator wall. Hence, the amplitude of the complementing mode becomes sufficiently large in order to at least partly cancel the main evanescent mode just below the open horizontal applicator end (noting that this evanescent mode is phaseless). The phase of about 245° (180°+65°) from the applicator ceiling is what is needed for resonance in consideration of the impedance jumps of the modes at the applicator opening, which is a significant field amplitude cancellation effect (more than half), such that the magnetic (H) fields cancel significantly is the relative amplitudes of the two modes are approximately equal in that region. The result of this is that the inherent field pattern of the $TEy_{31}$ mode will not be disturbed much by the cessation of the vertical applicator wall, and will continue straight downwards. The optimization of this effect and the mode balance can be performed by electromagnetic modeling rather than by tedious experiment, once the desired field structure conditions are known.

Figure 3:
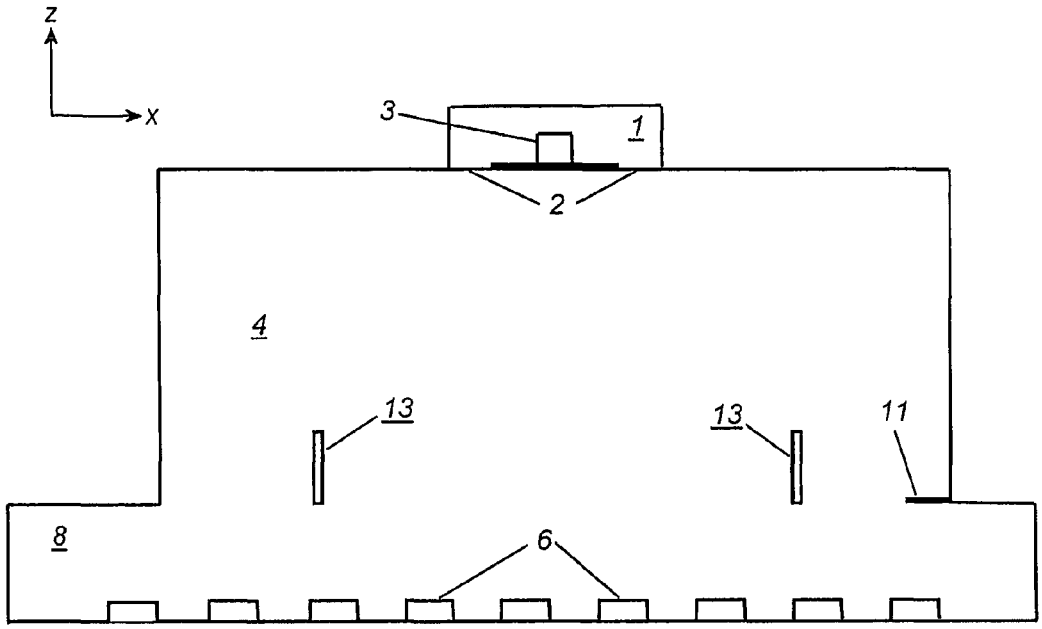
FIG. 3 shows a single applicator according to the present invention, designed for a $TEy_{51}$ main power transferring evanescent mode.

In another example, the applicator is designed for an evanescent $TEy_{51}$ mode as the main carrier of power. An applicator of this kind is schematically shown in FIG. 3, where the applicator dimensions now are 308×305×105 mm. Since a larger number of modes can be supported by a larger cavity or applicator, there is now a need to stabilize the desired mode so that it becomes neither distorted nor degenerate with some unwanted mode. This stabilization is provided by means of metal plates 13, as shown in the figure. These plates 13 are positioned longitudinally along the y-direction, and are provided close to the applicator opening. The optimization can of course be made by experiment, but electromagnetic modeling is nowadays a much faster method. Again, it is helpful to consider the influence of the optimization in terms of field patterns.

The microwave feed arrangement according to the invention will now be described.

The dimensions of the inventive applicator are such that the dominating evanescent mode has a quite low imaginary (capacitive) impedance. Therefore, a significant impedance transformation and also reactive compensation must occur in the applicator feed region. To some degree, these more severe problems are addressed in the above-referenced prior art, where it is claimed that only a vertical feed plane at the top side of an applicator wall provides good conditions for impedance matching.

According to the present invention, a first impedance reduction in the transition between the feeding waveguide and the applicator is obtained by using a combination of parallel slots 2 in the feeding $TE_{10}$ waveguide 1, connecting the waveguide to the applicator ceiling. A second impedance reduction is achieved by using a rather low waveguide (i.e. a waveguide having a small b dimension); 20 or 25 mm are typical b dimensions according to the present invention, while the a dimension is 86 mm. A third impedance reduction is obtained by using comparatively narrow and short slots 2 (typical dimensions 60×12 mm for each slot). However, such slots can be quite inductive, so a fourth impedance reduction (and matching) is obtained by the introduction of a comparatively large metal post 3 at the centerline of the waveguide, between the slots, said post having the dimensions 10×20×12 mm (x,y,z).

There will then be a need for increasing the waveguide impedance, and also creating a proper waveguide transition for the microwave generator, typically a magnetron. This is made by known techniques to increase the b dimension of a section of the waveguide, possibly in combination with a so-called E-knee which then provides a vertical waveguide section which can have the desired length and also protect the magnetron against heating and contamination by the applicator during operation.

Furthermore, the present invention also deals with the need for reducing the action and spreading-out of LSM modes created by the major applicator $TEy_{m1}$ mode. As stated above, this is done by making corrugations or introducing conducting structures 6 (such as metal rods) at the tunnel bottom. At a microwave frequency of 2450 MHz, a typical electrical height of 10 and 20 mm between the metal bottom and the underside of the load items provides desired conditions for under-heating by LSM modes. A corrugation height of 7 to 15 mm will then reduce the unwanted x-directed spread-out beyond the horizontal footprint of each applicator. The metal structures or corrugations 6 should typically not be more than what is just needed for this action, since the desired under-heating may otherwise become too weakened. As an alternative or complement, a thick piece of glass or similar material may be used, in analogy with the function as that of a turntable in household microwave ovens. As for the inventive features described above, the optimization of this function can nowadays be performed by electromagnetic modelling rather than by tedious experiment, once the desired field structure conditions are known.

The invention also addresses the need to reduce microwave leakage, primarily at the tunnel ends. Microwave leakage becomes prominent for arrangements with large tunnel heights, which can be achieved with the applicator according to the present invention. By using a known type of mode choke at the horizontal upper and lower planes of the tunnel ends, a quite efficient reduction can be obtained with a short such section for total tunnel heights of more than 130 mm. Since the vertical tunnel wall currents at the applicators using the particular modes according to this invention have a strong vertical component away from the applicator, a choke of known type can be employed. However, according to the present invention, the choke should have a particular length and placement. The length should typically be 250 mm or more, and the y-directed location of the choke should be such that the choke begins just after the last vertical x-directed wall of the last applicator, and the z-directed location should be about 20-30 mm below the opening plane of the applicators.

Moreover, in some cases it can be an advantage to heat the load not only from above (as in the previous examples), but also from below. In particular, this may be the case when the load is present close to the applicator opening. When using opposite applicators to achieve heating from two sides, it is preferred to have the applicators displaced sideways one quarter of the applicator wavelength, in order to reduce coupling between these opposite applicators. It should be noted that no heating by LSM-waves occur in such case. Therefore, the free height adjacent the load should be chosen such that multimode phenomena are minimized in these regions; but this might however not be necessary if the absorption in the load is sufficiently high.

The applicators according to the present invention can also be cylindrically curved at the open end thereof in order to heat a load having a cylindrical surface. In this context, the applicator is preferably curved along a cylindrical shape having its axis parallel to the y-direction. Also, it is possible to arrange a plurality of curved applicators around the periphery of such a cylindrical shape, effectively providing a sector-wise or full turn cylindrical microwave applicator arrangement for beating cylindrical loads. In this latter case, it is of course preferred to make the arrangement such that all the applicators are similar.

CONCLUSION

A new type of microwave applicator has been disclosed. The applicator according to the invention makes use of an evanescent main power-transferring mode. This evanescent mode is complemented by a second mode, which is a propagating mode that has the purpose of providing a counter-directed magnetic field in the y-direction at the horizontal, y-directed applicator wall opening. The effect of the cooperation of the two applicator modes is that the field pattern extends over a significant distance below the applicator opening, such that a load placed below the applicator opening is heated by a field pattern of the mode combination.

The invention claimed is:

1. A rectangular microwave applicator operating at a predetermined operating frequency, having first and second transverse dimensions and a longitudinal dimension, the dimensions being selected, in relation to said predetermined operating frequency, such that the applicator supports a first evanescent $TEy_{m:1}$ hybrid mode and a second propagating $TEy_{m-2k:}$ hybrid mode, where m is an odd integer larger than 1 and k is a positive integer, and where m-2k is positive, the applicator comprising two parallel feeding slots arranged in the ceiling of the applicator, connecting the applicator to a feeding waveguide, and further comprising an impedance transforming reactive element arranged centrally in the waveguide between the feeding slots.

2. An applicator as claimed in claim 1, wherein the evanescent mode has a decay distance approximately equal to the longitudinal dimension of the applicator.

3. A microwave heating arrangement, comprising at least two microwave applicators according to claim 2, said at least two applicators being arranged opposite each other in order to heat a load placed between said applicators.

4. A microwave heating arrangement, comprising a plurality of microwave applicators according to claim 2, said applicators being arranged side by side in a cylindrical configuration.

5. An applicator as claimed in claim 1, wherein the feeding waveguide is a $TE_{10}$ waveguide.

6. An applicator as claimed in claim 5, wherein each of the slots has the dimension 60×12 mm adapted for operation at the ISM frequency of 2450 MHz.

7. An applicator as claimed in claim 6, further comprising a metal post arranged centrally in the waveguide between the feeding slots.

8. An applicator as claimed in claim 5, further comprising a metal post arranged centrally in the waveguide between the feeding slots.

9. An applicator as claimed in claim 1, wherein the impedance transforming reactive element comprises a metal post arranged centrally in the waveguide between the feeding slots.

10. An applicator as claimed in claim 9, wherein the dimensions of said metal post are 10×20×12 mm in the x-, y- and z-directions adapted for operation at the ISM frequency of 2450 MHz.

11. An applicator as claimed in claim 1, comprising at least two metal rods or plates extending between opposite applicator walls.

12. An applicator as claimed in claim 1, comprising means for reducing unwanted propagation of LSM modes beneath a load placed under the applicator.

13. An applicator as claimed in claim 12, wherein said means for reducing unwanted propagation of LSM modes comprises a corrugated metal plate or metal profiles.

14. An applicator as claimed in claim 13, wherein said corrugated metal plate or said metal profiles have a height of 7 to 15 mm adapted for operation at the ISM frequency of 2450 MHz.

15. An applicator as claimed in claim 1, wherein the open end of the applicator is curved in a cylindrical shape.

16. A microwave heating arrangement, comprising at least two microwave applicators according to claim 1, said at least two applicators being arranged opposite each other in order to heat a load placed between said applicators.

17. An arrangement as claimed in claim 16, wherein said at least two applicators are displaced sideways one quarter of the applicator wavelength.

18. A microwave heating arrangement, comprising a plurality of microwave applicators according to claim 1, said applicators being arranged side by side in a cylindrical configuration.

19. An arrangement as claimed in claim 18, wherein each of the applicators has a cylindrically curved open end.

* * * * *